US006134815A

United States Patent [19]

Rohr

[11] Patent Number: 6,134,815

[45] Date of Patent: Oct. 24, 2000

[54] MONITORING DEVICE FOR MOTOR-DRIVEN UNDERWATER GRAB BUCKET DREDGE GEAR

[75] Inventor: Wolfgang Rohr, Waldsee, Germany

[73] Assignee: Rohr GmbH, Otterstadt, Germany

[21] Appl. No.: 09/248,344

[22] Filed: Feb. 11, 1999

[30] Foreign Application Priority Data

Feb. 18, 1998 [DE] Germany ..... 198 06 816

[51] Int. Cl.[7] ..... E02F 9/26

[52] U.S. Cl. ..... 37/308; 37/340; 37/187

[58] Field of Search ..... 37/307, 308, 309, 37/316, 340, 341, 342, 461, 184, 185, 186, 187, 188, 348, 382; 294/68.23; 701/50

[56] References Cited

U.S. PATENT DOCUMENTS 5,189,605 2/1993 Zuehlke et al. ..... 364/140
5,297,019 3/1994 Zuehlke ..... 364/140
5,443,294 8/1995 Prinz et al. ..... 294/68.23
5,553,404 9/1996 Bergeron ..... 37/184
5,964,256 10/1999 Bedi et al. ..... 141/83
5,995,916 11/1999 Nixon et al. ..... 702/182
6,024,145 2/2000 Ackles ..... 144/382

*Primary Examiner*—Victor Batson
*Attorney, Agent, or Firm*—Collard & Roe, P.C.

[57] ABSTRACT

A monitoring device for motor-driven underwater grab bucket dredges contains a bucket gear suspended on a cable. The device ensures reliable monitoring and controlling of the operating condition of the bucket gear 4. There is at least one sensor connected to the grab bucket gear for sensing a measured value. There is a computer connected to the sensor for representing the measured value detected by the sensor.

21 Claims, 2 Drawing Sheets

MONITORING DEVICE FOR MOTOR-DRIVEN UNDERWATER GRAB BUCKET DREDGE GEAR

BACKGROUND OF THE INVENTION

1. Field of the Invention

The present invention relates to a monitoring device for a motor-driven underwater grab bucket dredge gear.

2. The Prior Art

A switch-off device for crane equipment comprising a cable or motor-driven grab bucket gear suspended on a cable, as well as a hoisting gear, is disclosed in European Patent No. EP-A-0 219 007. The crane equipment comprises a switch-off device for detecting whether the rope or cable guided via reversing rollers is slack or taut. An initiator for generating pulses is mounted on one of the reversing rollers in order to shut down the drive in the absence of the pulses. With the floating dredge equipped with an underwater grab bucket gear, the switch-off device permits the hoisting gear to be shut off independently of the weight, and prevents the grab bucket gear from toppling over on the bottom of the sea.

SUMMARY OF THE INVENTION

It is an object of the present invention to further develop the monitoring device so that reliable monitoring and controlling of the operating conditions of the grab bucket gear are ensured. The equipment of the dredge must function safely and have a long useful life even under rough working and operating conditions.

The device according to the invention permits safe operation even under the most difficult operating conditions. At least one sensor is connected to the grab bucket gear. The signals emitted by the sensor are supplied to a data transmission system in order to be further transmitted to a control system via a bus line. The bus line is integrated in the hoisting cable and/or in a feed cable, and the control system is a memory-programmable control system. Control commands are generated by the control system and supplied to a controller of the motor drive of the grab bucket gear. The controller comprises a frequency converter. A computer and/or a monitor for visualizing the relevant data are connected to the control system. The relevant operating conditions and/or deviations from permissible values can be immediately signaled to the operator of the equipment on the video screen visually and/or acoustically along with graphic symbols.

The limit values of the measured quantities can be adjusted via the computer and/or limit value monitors associated with the computer. Thus, no changes or adjustments are required directly on the grab bucket gear. Furthermore, when pre-settable limit values are reached, the drive can be switched off immediately. It is therefore possible to avoid serious damage and thus expensive and lengthy repair work. Moreover, each message, combined with the date and time, can be stored and/or printed out on a printer.

The device as defined by the invention permits continuous monitoring of the functions of the grab bucket equipment, which is in the form of a motor-driven underwater grab bucket gear. The important operating parameters can be sensed and monitored by the one or several sensors, to determine the position of the buckets of the grab gear, the inclination of the grab bucket gear, the oil level in an oil sump of the motor, the oil temperature, the closing pressure and the opening pressure, as well as the condition of the oil filter. According to the invention, each of these parameters, and preferably several or all of the operating parameters, are monitored and continually evaluated. Feeding the driving motor of the grab bucket gear via the frequency converter ensures shock-free start-up and slowing down as well as optimized control of the closing and opening speeds of the grab buckets.

The proposed device permits exact information about the operating condition at any time as well as rapid detection of any possible trouble. When preset limit values are exceeded, rapid and on-target reaction can take place to avoid damage. Furthermore, unscheduled costly shutdown periods of the crane equipment are avoided by detecting tendencies, and maintenance or service measures can be scheduled in due time. Safe protection against heavy and bulky wood debris is made possible in connection with underwater grab bucket gear. controlling the speed (rpm's) via the frequency converter assures careful treatment of the mechanics. The motor speed and thus the cycle times as well as the delivery rate are adjusted through the variable speed (or rpm's) depending on the material to be dredged. By employing the inclination value transmitter, the grab bucket gear is safely prevented from tilting over. Furthermore, power peaks during start-up of the motor are prevented by the frequency converter, which means energy is saved. Finally, the distance value transmitters achieve defined shutdown of the motor in pre-settable end positions of the grab buckets, and the mechanical components are consequently treated in a careful way.

BRIEF DESCRIPTION OF THE DRAWINGS

Other objects and features of the present invention will become apparent from the following detailed description considered in connection with the accompanying drawings which disclose one embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
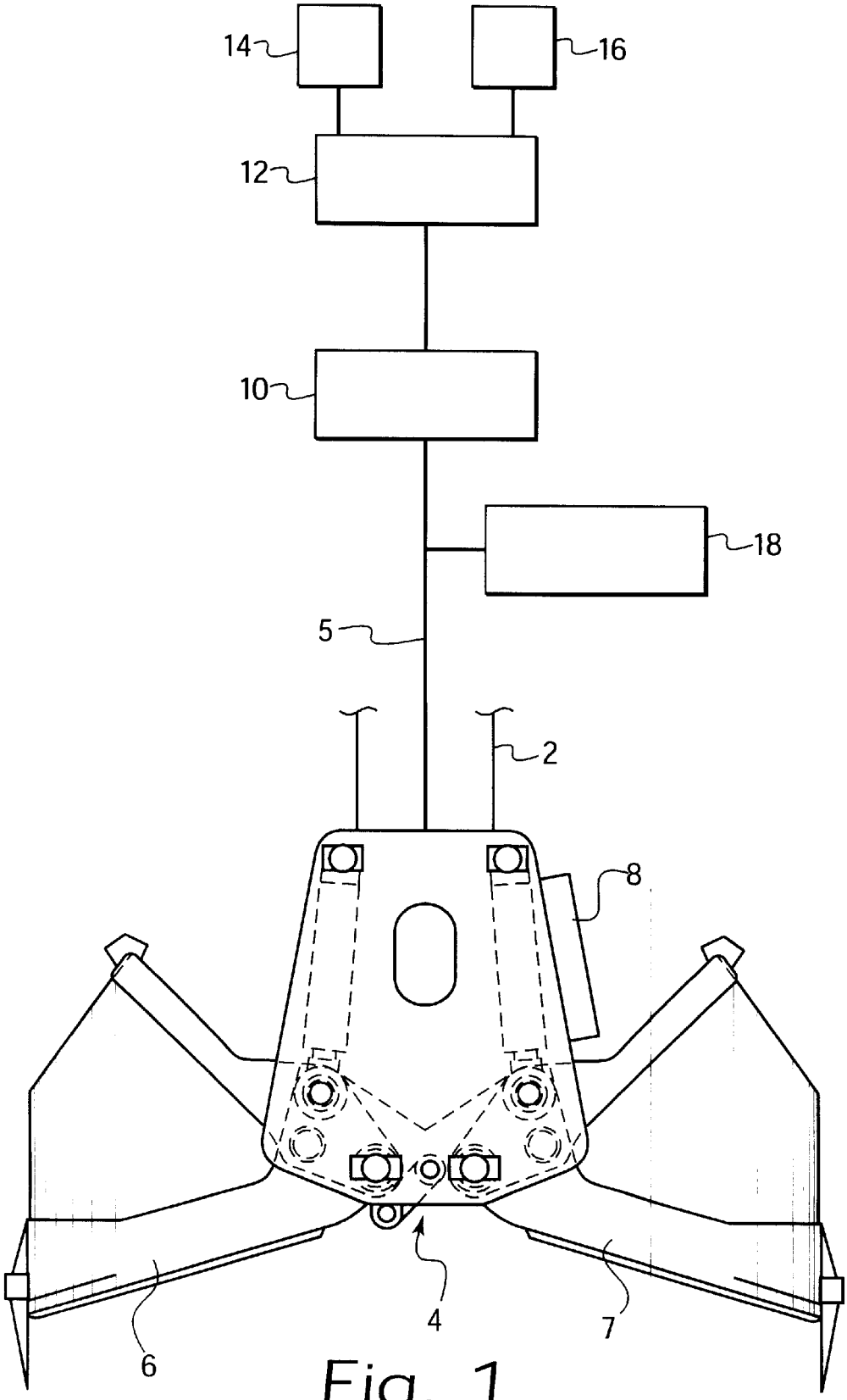
FIG. 1 is a basic view of the bucket dredge gear.

Referring in detail to the drawings, FIG. 1 shows the grab bucket dredge gear 4 suspended on a cable 2. Gear 4 is designed as a cable or motor-driven grab bucket gear, and in particular as a hydraulically driven grab bucket gear. Gear 4 comprises two pivotally mounted grab buckets 6 and 7, a hydraulic motor (not shown here), as well as a switchbox 8 with electronic components. A special line or feed cable 5, which trails grab bucket gear 4 via reversing rollers as gear 4 is being lifted or lowered, supplies gear 4 with energy. The sensors installed in the grab bucket gear and the evaluation electronics of gear 4 are supplied via feed line 5 as well.

The measured values are transmitted via a bus line, in particular a two-wire bus line, which is incorporated in the same line 5. PROFIBUS DP, which is the standard worldwide, is preferably employed for transmitting the data, and assures high-speed data transmission and very short reaction times. The data transmitted via the integrated bus line are evaluated in a freely programmed control system 10 and subsequently transmitted to a computer 12, such as an industrial PC with a video screen 14. Computer 12 contains a visualization program for editing the data in order to display it in video screen 14 in the form of graphic symbols. Limit values can be preset by control system 10, and deviations from permissible values are immediately indicated to the equipment operator visually or acoustically. If the limit values are exceeded, the drive is switched off immediately, if necessary. A printer 16 is connected to computer 12, so that each measured value and each message can be optionally printed out together with the date and time.

There is a controller 18 for the motor, which is preferably arranged in grab bucket gear 4 and drives grab buckets 6 and 7. Controller 18 contains a frequency converter, which enables careful treatment of the mechanics and adaptation of the motor speed by controlling the number of revolutions of the motor. By varying the speed of the motor, the cycle times and the rate of delivery are adaptable depending on the material being dredged.

Figure 2:
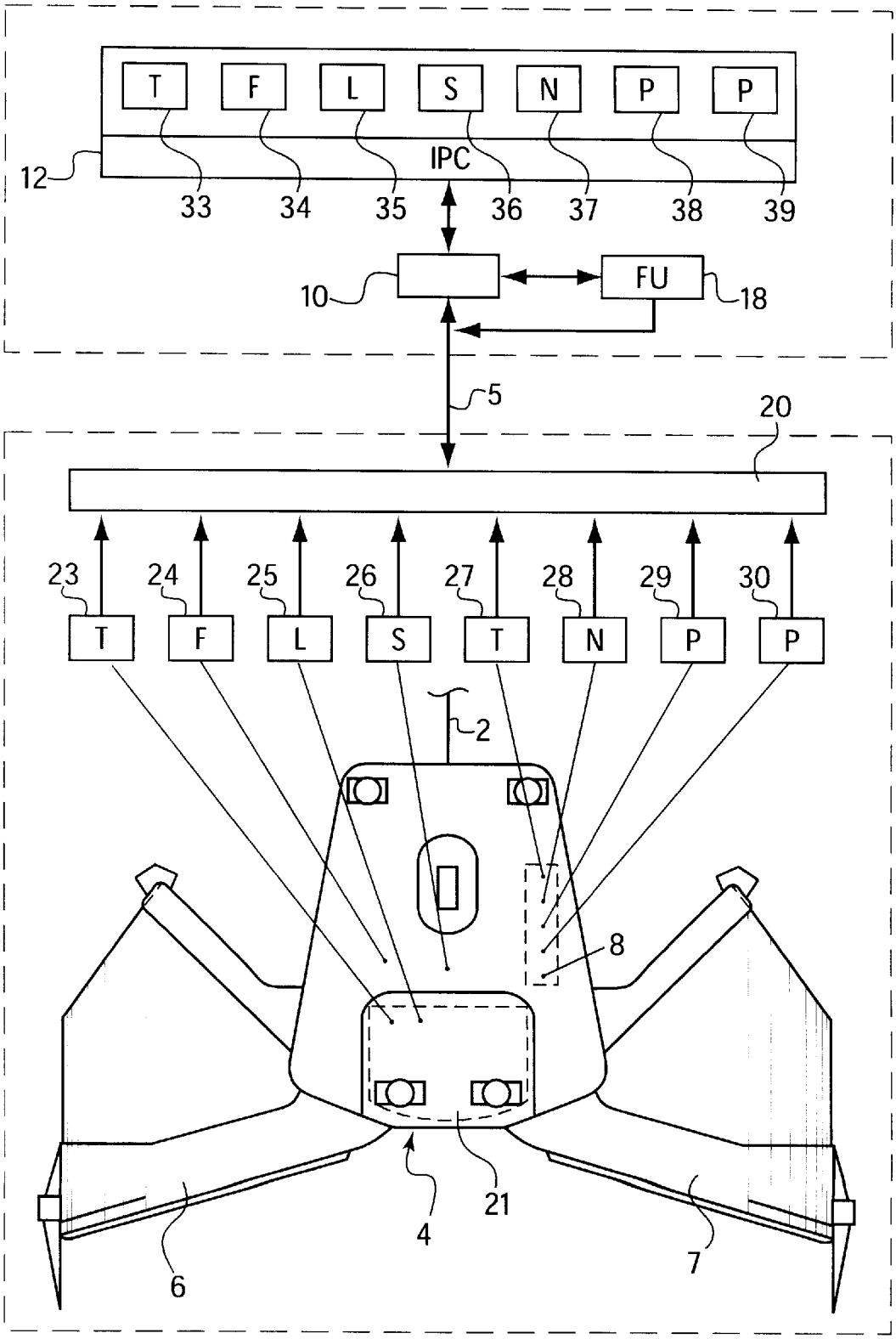
FIG. 2 is a block diagram of the system according to the invention.

FIG. 2 shows a block diagram of grab bucket gear 4 with integrated data transmission system 20 with PROFIBUS. Via a special line 5, which is preferably a CORDALFLEX cable, and in which the bus line is integrated, the data or measured values from the transmitters are sent via data transmission system 20 to the memory-programmable control system 10.

There are preferably several sensors in grab bucket gear 4, in oil sump 21, and in electronics switchbox 8. An oil temperature sensor 23 is located in oil sump 21. A sensor 24 in the grab bucket gear monitors the filter, and an oil level sensor 25 is arranged in oil sump 21. The degree of contamination of the oil filter is preferably continually detected via a device that monitors the difference in pressure, and indicated by computer 12 and/or the video screen. In this way, a required change of the oil filter can be detected in due time and the filter needs to be replaced only when the preset degree of contamination of the filter has been reached. The operation is therefore considerably enhanced as compared to filter changes at preset time intervals.

Furthermore, grab bucket gear 4 contains a sensor 26 for indicating the position of the buckets. In addition, there is a temperature sensor 27 which detects any excess temperature of the motor.

According to a further development of the invention, there is a sensor 28 for detecting the inclination of grab bucket gear 4. According to the invention, the given instantaneous position or inclination of grab bucket gear 4 can be monitored via the video screen, and the bucket gear thus can be prevented from overturning, which, in practical life, is quite troublesome. When a preset limit value of inclination is exceeded, the drive for lowering the bucket gear can be switched off, and/or the motor for lifting the bucket gear can be switched on. Furthermore, the motor driving the grab buckets can be switched off depending on the detected degree of inclination, and preferably when a preset limit value is exceeded.

Finally, there is a sensor 29 for detecting the closing pressure, and a sensor 30 for detecting the opening pressure. As stated above, the signals or data emitted by sensors 23 to 30 are transmitted to data transmission system 20 and then to the memory-programmable control system 10 via the bus line which is integrated in the feed cable or special line 5.

Sensor 26 for detecting the position of the grab buckets is preferably designed as an angle-of-rotation sensor and/or absolute value sensor. The limit values for setting the grab buckets and for closing them are readjustable by computer 12, so that an adjustment of the grab bucket gear 4 itself is required only when the sensor is replaced. The actual position of the grab buckets is always displayed on video screen 14 of computer 12. Defined switch-off in the end positions as well as safe detection of bulky wood debris is made possible due to the exact information available about the position of grab buckets 6, 7.

Sensor 25 is preferably a level sensor for detecting the oil level in the oil sump of the hydraulic system. The limit values for warning, minimum level and maximum level can be changed directly on the video screen of computer 12, so that no adjustment is required directly on grab bucket gear 4 itself. Since the actual filling level of oil sump 21 is always displayed on video screen 14 of computer 12, both any loss of oil and possible penetration of water in oil sump 21 can be detected very early.

Sensor 23 for measuring the oil temperature is preferably a PT 100-sensor and the temperature detected by sensor 23 is indicated on video screen 14 of computer 12 as an absolute value. The limit values of the oil temperature can be directly adjusted via computer 12 as well, so that again, no complicated adjustment is needed on the sensor or grab bucket gear itself.

Sensors 29 and 30 for the closing pressure and the opening pressure of the grab buckets are arranged on their respective cylinders on the bucket gear motor. These values are preferably detected via pressure transmitters and are indicated on video screen 14 of computer 12 as absolute values. The limit values for the closing and opening pressures are adjusted with computer 12 as well without any intervention on the grab bucket gear.

Sensor 28 for detecting the inclination of the bucket gear allows the slant of the gear to be usefully detected and monitored on a single axis transverse to the suspension of the cable and always instantaneously indicated on video screen 14 of computer 12. The limit values for the permissible slant are adjustable by computer 12 as well. When the permissible angle of inclination is exceeded, the lowering movement of the bucket gear is switched off and bucket gear 4 is safely prevented from tilting. Also, damage to the crossbeam on which the bucket gear is displaceably suspended, as well as to the cables and to the special line or feed cable 5 due to tilting over of the bucket gear, is safely prevented.

Sensor 24 monitors the filter and detects the degree of contamination of the oil filter by monitoring the difference in pressure. This is indicated via computer 12 on video screen 14, and any required change of the oil filter is indicated in due time. The oil filter has to be changed only when the preset degree of contamination has been reached. This offers considerable operational benefits versus routinely changing the filter according to preset time intervals.

Computer 12 with video screen 14 and printer 16, which is connected to control system 10, permits visualization and, if need be, printout of the data or measured values acquired in this manner. The limit values for the measured values are usefully adjusted by means of computer 12 without requiring any intervention on grab bucket gear 4. The changed limit values are immediately supplied to the control program. Computer 12 contains a limit value unit 33 for the oil temperature, a limit value unit 34 for monitoring the filter, and a limit value unit 35 for the oil level. Furthermore, there is a limit value unit 36 for indicating the position of the grab buckets, a limit value unit 37 for the inclination of the bucket gear, and limit value units 38 and 39 for the closing and opening pressures, respectively. The respective limit values can be displayed on video screen 14 and input as required by an input unit such as a keyboard or a mouse of the computer.

Accordingly, while only a single embodiment of the present invention has been shown and described, it is to be understood that many changes and modifications may be made thereunto without departing from the spirit and scope of the invention as defined in the appended claims.

What is claimed is:

1. A monitoring device for a motor-driven underwater grab bucket dredge gear suspended on a cable, comprising:

at least one sensor adapted to be connected to the bucket gear and adapted to detect at least one measured value; and a computer connected to said at least one sensor and adapted to represent said at least one measured value measured by said at least one sensor; and a data transmission system connected to said at least one sensor, said system containing a PROFIBUS, wherein the data transmission system is adapted to be arranged on the bucket gear.

2. The device according to claim 1, further comprising a memory-programmable control system connected to said data transmission system and said at least one sensor, wherein the data are transmitted via a two-wire bus line.

3. The device according to claim 2, wherein the bus line is integrated in a cable, said cable supplying energy to a motor of the motor-driven bucket dredge gear.

4. The device according to claim 3, wherein the control system is connected to a controller for the motor of the bucket gear, said controller containing a frequency converter.

5. The device according to claim 1, wherein the computer presets a limit value for the measured value detected by said at least one sensor.

6. The device according to claim 5, wherein the computer has limit value units for presetting limit values of the measured values detected by the sensor.

7. A monitoring device for a motor-driven underwater grab bucket dredge gear suspended on a cable, comprising:

at least one sensor adapted to be connected to the bucket gear and adapted to detect at least one measured value;

a computer connected to said at least one sensor and adapted to represent said at least one measured value measured by said at least one sensor; and a data transmission system connected to said at least one sensor, said system containing a PROFIBUS, wherein the data transmission system is adapted to be arranged in a switchbox of the bucket gear.

8. The device according to claim 7, wherein the computer presets a limit value for the measured value detected by said at least one sensor.

9. The device according to claim 8, wherein the computer has limit value units for presetting limit values of the measured values detected by the sensor.

10. The device according to claim 7, further comprising a memory-programmable control system connected to said data transmission system and said at least one sensor, wherein the data are transmitted via a two-wire bus line.

11. The device according to claim 10, wherein the bus line is integrated in a cable, said cable supplying energy to a motor of the motor-driven bucket dredge gear.

12. The device according to claim 11 wherein the control system is connected to a controller for the motor of the bucket dredge gear, said controller containing a frequency converter.

13. A monitoring device for a motor-driven underwater grab bucket dredge gear suspended on a cable, comprising:

at least one sensor adapted to be connected to the bucket rear and adapted to detect at least one measured value;

a computer connected to said at least one sensor and adapted to represent said at least one measured value measured by said at least one sensor; and a data transmission system connected to said at least one sensor, said system containing a PROFIBUS, wherein the data transmission system is integrated in the bucket gear.

14. The device according to claim 13, wherein the computer presets a limit value for the measured value detected by said at least one sensor.

15. The device according to claim 14 wherein the computer has limit value units for presetting limit values of the measured values detected by the sensor.

16. The device according to claim 13, further comprising a memory-programmable control system connected to said data transmission system and said at least one sensor, wherein the data are transmitted via a two-wire bus line.

17. The device according to claim 16, wherein the bus line is integrated in a cable, said cable supplying energy to a motor of the motor-driven bucket dredge gear.

18. The device according to claim 17, wherein the control system is connected to a controller for the motor of the bucket gear, said controller containing a frequency converter.

19. A monitoring device for a motor-driven underwater grab bucket dredge gear suspended on a cable, comprising:

at least two sensors, wherein one sensor detects inclination of the bucket gear and another sensor detects the position of the grab bucket;

a computer connected to said at least two sensors and adapted to represent said at least two measured values measured by said at least two sensors; and a data transmission system connected to said at least two sensors, said system containing a PROFIBUS.

20. A monitoring device for a motor-driven underwater grab bucket dredge gear suspended on a cable, comprising:

at least three sensors, one sensor sensing oil temperature, another sensor monitoring a filter and another sensor monitoring oil level, said sensors being arranged in an oil sump of the bucket gear;

a computer connected to said at least three sensors and adapted to represent said at least three measured values measured by said at least three sensors; and a data transmission system connected to said at least three sensors, said system containing a PROFIBUS.

21. The device according to claim 20, wherein there is a sensor for detecting closing pressure and a sensor for detecting opening pressure of the grab bucket, and wherein the bucket gear contains the sensor for monitoring the oil level, the sensor for detecting motor temperature, the sensor for detecting the closing pressure and the sensor for detecting the opening pressure of the grab bucket.

* * * * *